United States Patent [19]

Carlson

[11] 4,006,321

[45] Feb. 1, 1977

[54] TRANSDUCER COUPLING SYSTEM

[75] Inventor: Elmer V. Carlson, Prospect Heights, Ill.

[73] Assignee: Industrial Research Products, Inc., Elk Grove Village, Ill.

[22] Filed: June 14, 1976

[21] Appl. No.: 695,329

Related U.S. Application Data

[63] Continuation of Ser. No. 444,036, Feb. 20, 1974, abandoned.

[52] U.S. Cl. ..... 179/180; 179/107 FD

[51] Int. Cl.[2] ..... H04R 1/22; H04R 25/00

[58] Field of Search ..... 179/1 DM, 107 R, 107 E, 179/107 FD, 121 D, 156 R, 156 A, 178, 180, 182 R; 181/126, 128, 129, 130, 131, 132, 134, 135, 137

[56] References Cited

UNITED STATES PATENTS

| | | | |
|---|---|---|---|
| 2,262,146 | 11/1941 | Massa | 179/121 D |
| 2,789,651 | 4/1957 | Daniels | 179/1 DM |
| 2,865,464 | 12/1958 | Gorike | 179/121 D |
| 3,193,048 | 7/1965 | Kohler | 179/107 FD |
| 3,835,263 | 2/1973 | Killion | 179/107 FD |

FOREIGN PATENTS OR APPLICATIONS

| | | | |
|---|---|---|---|
| 1,158,116 | 11/1963 | Germany | 179/121 D |

*Primary Examiner*—George G. Stellar
*Attorney, Agent, or Firm*—Leo J. Aubel

[57] ABSTRACT

A transmission system is disclosed having an improved means for coupling sound to and from a transducer. The system includes a main sound channel and an associated cavity; damping elements are selectively positioned in or adjacent the cavity to provide a suitable acoustic impedance in the desired operating frequency range to effect a smooth acoustical operation.

6 Claims, 11 Drawing Figures

FIG. 4
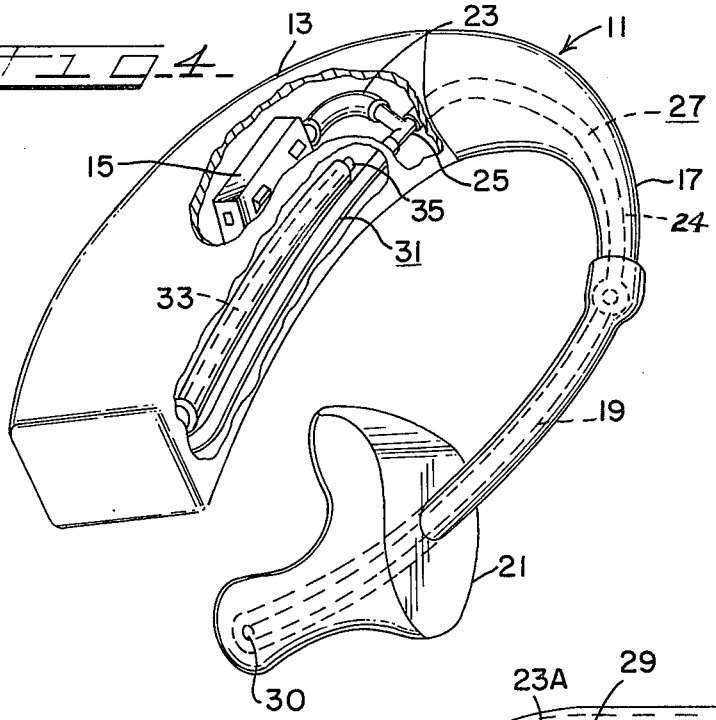
FIG. 5
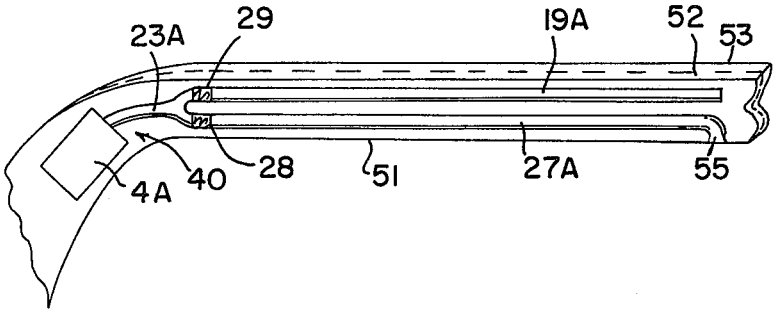
FIG. 4A
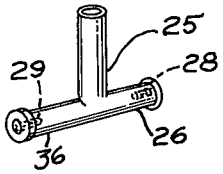
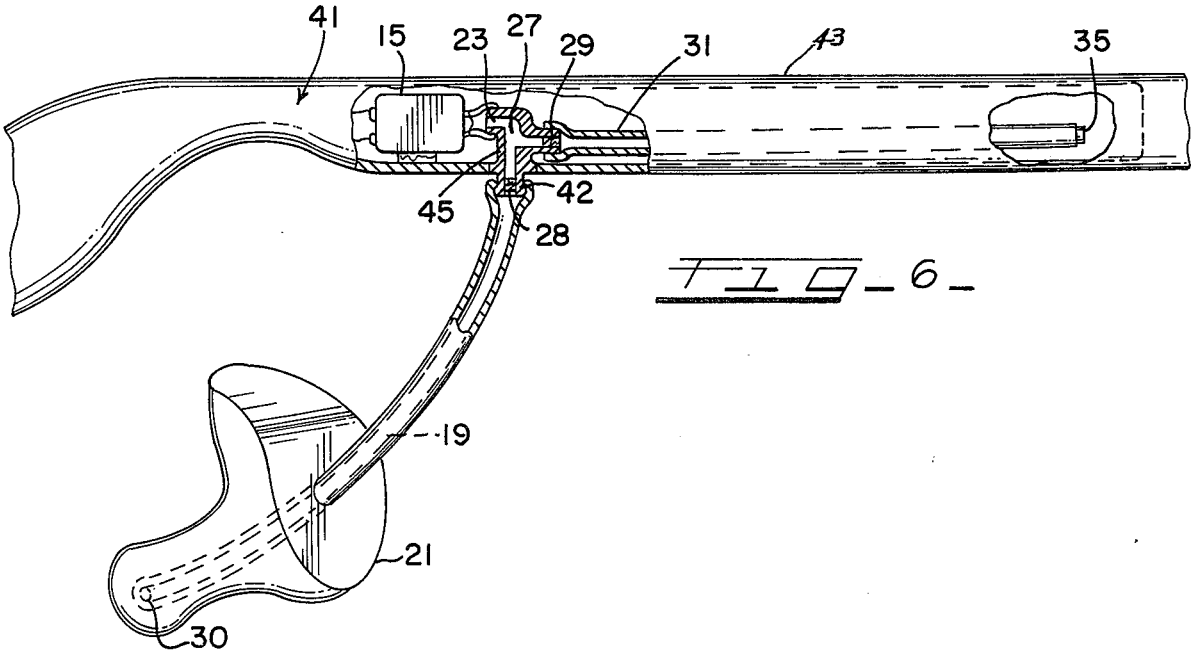
FIG. 6

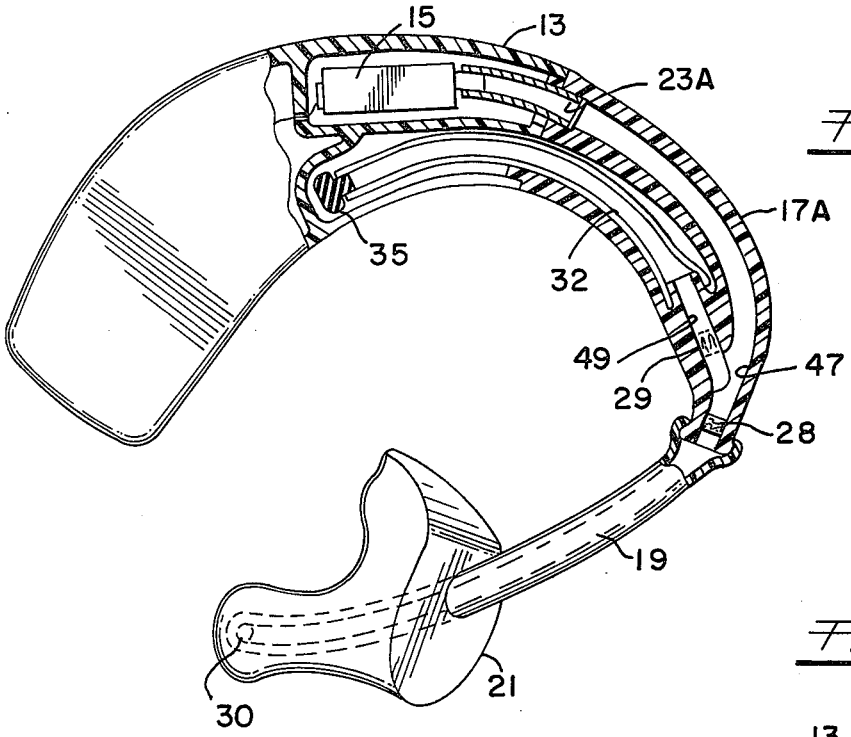
FIG. 7
FIG. 8
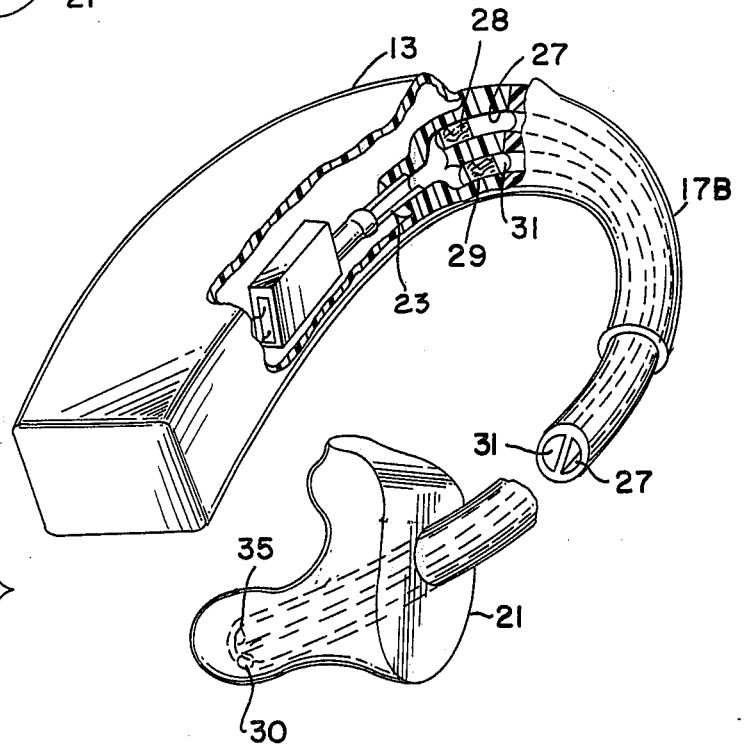
FIG. 9
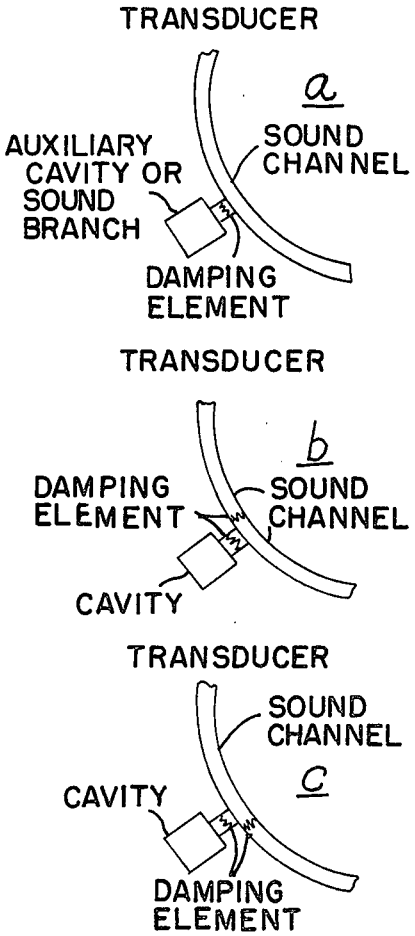
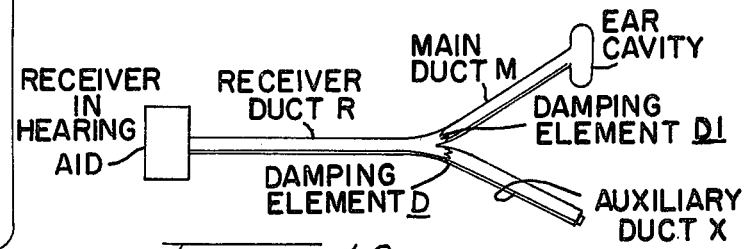
FIG. 10

TRANSDUCER COUPLING SYSTEM

This is a continuation of application Ser. No. 444,036, filed Feb. 20, 1974 now abandoned.

BACKGROUND OF THE INVENTION

The prior art discloses electro-acoustic apparatus wherein the associated transducer is located in a housing and the sound output or sound input is coupled through suitable acoustic ducts or tubing to the hearing canal or source of sound. One common application is as components of headsets worn by telephone operators. Another application is as transducers, that is as microphones and receivers in hearing aids wherein the transducer is located within the hearing aid housing. In the application of the transducer as a hearing aid receiver, an acoustic passage from the receiver extends through part of the hearing aid and connects to a length of flexible tubing which couples into an ear mold that substantially seals to a portion of the hearing aid canal. The ear mold creates an effectively closed chamber to couple the sound from the receiver to the ear drum. Also a duct may be used to couple sound from an appropriate operative location to the microphone.

The sound passage, usually comprising a duct or channel, can be of a single length of tubing, but commonly the duct comprises several pieces of tubing which pieces may be of different areas and which may be joined to provide the necessary length of duct.

For example, a common length of ducts used in hearing aids to form the sound channel from the receiver to the chamber adjacent the ear is of the order of two to three inches. Tubing of the foregoing length possesses resonant modes within the frequency range of the normal hearing and these resonances create varying impedance and transmission parameters than can interact with the impedance and transmission parameters of the receiver to provide a fluctuating transmission characteristic to the hearing canal.

Damping elements or materials have previously been added to prior art systems to dampen the amplitude of these fluctuations. There are several places where the insertion of a damping element into the acoustic path has been considered to be functionally acceptable. One such location is in, or adjacent, the receiver wherein the damping elements may actually form a part of the receiver. Another location applicable in a behind-the-ear hearing aid is where the flexible tubing is attached. More specifically, in a receiver for such a behind-the-ear hearing aid application, the most effective point at which to install the damping element is at the end of the duct where it connects to the chamber adjacent the ear drum. At this latter point, a damping element of proper impedance can produce a smooth transmission characteristic. Likewise, when a damping element is provided for a microphone, a damping element is conveniently located adjacent the sound input to the duct. However, locating the damping element for the receiver system at the end of the channel adjacent the ear drum chamber; or, locating the damping element at the sound input of the microphone system develops practical problems, particularly for the reasons which will now be discussed.

Damping elements to be useful must consist principally of acoustic resistance. Known methods of obtaining resistance in acoustic paths (in the frequency range at which the earphone system is to function) comprise the provision of small passages or holes to assure that the resistance or dissipative component of the total impedance is more effective than the inertance component of the impedance. However, when the damping element which comprises small passages is used with a receiver in a hearing aid, the passages are readily stuffed or clogged by the excretions normally present in the ear; or, when a similar damping element is used with a microphone such as with a headset, the damping element may become contaminated or plugged up by moisture and dust. Accordingly, designers have heretofore attempted a compromise between locating the damping elements at a point where the element is most effective, but very apt to malfunction, or locating the damping element at a point where it is partially effective and reasonably free of malfunction.

Accordingly, it is a principal object of the present invention to provide an acoustic transmission system wherein the damping elements may be positioned, where there is minimal likelihood of malfunctioning, and still be of maximum effectiveness.

It is another object of the present invention to provide an acoustic transmission system having improved means for reducing the amplitude of fluctuations of the transmission characteristics within the operating frequency range.

It is another object of the present invention to provide an acoustic transmission system which enables the location of the damping elements at a point other than at the end of an acoustical duct, but which damping elements obtain a high degree of effectiveness.

The foregoing and other features and objects of the present invention will be apparent from the following more particular description of the preferred embodiments of the invention as illustrated in the accompanying drawings wherein:

DESCRIPTION OF THE DRAWINGS

FIG. 4 is one embodiment of the invention in a behind-the-ear type of hearing aid showing a folded tubing arrangement;

FIG. 4*a* is a relatively enlarged view of a three outlet connection or junction utilized in certain embodiments of the present invention;

FIG. 5 is an embodiment of the invention utilized with a microphone of an eyeglass type of hearing aid;

FIG. 6 is an embodiment of the invention utilized with a receiver of an eyeglass type of hearing aid;

FIG. 7 is an embodiment of the invention in a behind-the-ear hearing aid having a branch channel;

FIG. 8 is an embodiment of the invention in a behind-the-ear hearing aid having parallel channels;

FIGS. 9*a*, *b* and *c* are sketches useful in explaining the concept of the invention; and, FIG. 10 is an additional sketch also useful in explaining the concept of the invention.

DESCRIPTION OF THE INVENTION

Figure 1:
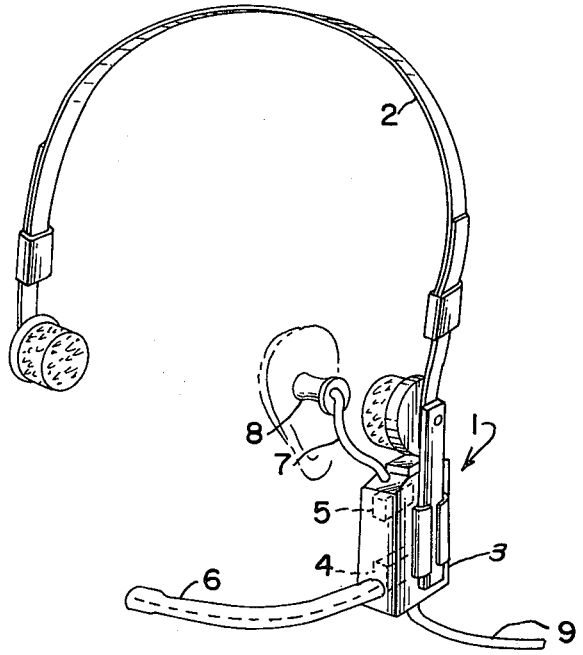
FIG. 1 is an isometric view of a headset including the earphone system of the invention.

Refer to FIG. 1 showing a headset with acoustical transducers; that is, with both a microphone and with a receiver. In FIG. 1, the earphone system 1 includes a headpiece 2, an assembly housing 3, a microphone 4

(indicated by the dotted lines), and a receiver 5 (also indicated by the dotted lines). The microphone 4 connects to a duct assembly 6 constructed in accordance with the invention, as will be explained.

The end of the duct assembly 6 is positionable to receive sound from the user's mouth. The receiver 5 connects to second duct assembly 7 similar to assembly 6; and, the end of the assembly 7 couples to an ear insert 8 and thence to the acoustic chamber formed in the user's ear. Electrical leads indicated generally at 9 connect the power; and, the signal input/output to the earphone system.

The present invention is useful with transducers generally; that is, with both microphones and receivers; and, the following explanation while referring, for convenience in explanation, to a receiver and to hearing aids is thus also applicable to microphones, and generally to earphone systems.

Refer now to some practical concepts concerning the location of damping elements in the acoustical transmission systems in accordance with the invention.

Consider a point for insertion of a damping element along the sound path, near the receiver so that a considerable part of the sound path remains between this point and the ear chamber or cavity. The length of duct or channel (comprising a tube or tubing) which is connected to the ear chamber is long enough to provide protection for the damping element and is located at a convenient mechanical site. The cavity formed in the ear can be approximated by an acoustical compliance having a value between 0.3 × 10-6 and 1.5 × 10-6 cgs units. Since most of the disturbing impedance interactions observed in practice are found to occur at 1,000 Hz and above (see FIG. 2), the tube or tubing is terminated with a negative acoustical reactance of less than 530 ohms. The diameters (bores) of the tubes or ducts that have been found to be acceptable usually have characteristic impedances in excess of 900 ohms, usually about 1500 ohms. The characteristic impedances of a tube is approximated by an acoustical resistance value, Zo, where:

$$Zo = \frac{\rho c}{A} = \frac{\text{Density of Air} \times \text{Speed of Sound}}{\text{Area of Tubing Bore}}$$

At the reference point of the connection of the receiver to the tube, the impedance looking from the receiver into the tube and toward the ear is that of an acoustical transmission line that is terminated in a low impedance. The input impedance of such line, at the frequencies at which the line is an odd number of quarter wavelengths long, will be high; at least many times the characteristic impedance of the tube. Satisfactory damping impedances normally have the values of the order of the characteristic impedance of the tube, and if inserted at this point, will have very little effect at these frequencies.

In other words, a damping element positioned at one location may produce a desirable effect at one frequency, but at another frequency it may be ineffective. There may be locations to insert the damping elements, usually found emperically, that for a given receiver and tubing produce more useful results than other locations.

One such location and value of damping element may not work equally satisfactorily for a variety of tubing lengths and a problem arises since the length of the tubing usually varies because it is adjusted to fit the particular individual who is to wear the hearing aid.

This invention discloses an acoustic transmission system which provides an output which is substantially smooth and free of high peaks in the operating frequency range. A basic concept of the invention is the provision of an auxiliary cavity or sound branch functioning as part of an acoustic transmission system as shown in the sketches of FIGS. 9*a*, 9*b*, and 9*c*.

The acoustic transmission system of FIGS. 9*a*, 9*b* and 9*c* comprises a sound channel or main sound passage acoustically coupled to the associated transducer. As mentioned above, the invention is applicable to both receivers and microphones, hence for purposes of explanation assume the transducer of FIGS. 9*a*, 9*b* and 9*c* is a receiver. Thus consider that the sound channel conveys sound from the receiver to the ear of the user. The auxiliary cavity or sound branch is provided in accordance with the invention, and a damping element is positioned as shown in FIGS. 9*a*, 9*b*, or 9*c*. In the absence of the auxiliary cavity, at certain frequencies, the acoustic impedance of the sound channel becomes very high and therefore, there is very little volume velocity at the location of the damping element in the sound channel; and, the insertion of a damping element has very little effect. However, the insertion of a damping element such as shown at the junction of the sound channel and the auxiliary cavity of FIG. 9*a* does have a damping action at these frequencies. The auxiliary cavity retains or constrains the sound within the acoustic transmission system.

The configuration shown in FIG. 9*a* will produce beneficial results at locations and frequencies where a damping element positioned in the sound channel is ineffective. And, this new construction of FIG. 9*a* may then be combined with the damping element means positioned in the sound channel as in FIG. 9*b* and 9*c* to obtain even more desirable results.

FIG. 2*a* shows, in curve *a*, the response of a receiver provided with a damping element such as indicated in FIG. 9*a;* and in curve *b* the response of the same receiver with no such damping element.

Figure 3:
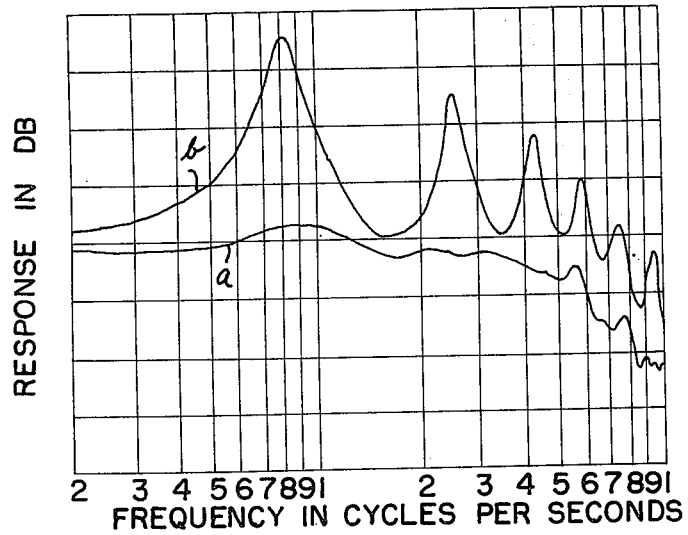
FIG. 3 is another graph useful in explaining some basic concepts of the present invention.

FIG. 3 shows in curve *a*, the response of a microphone provided with damping elements such as indicated in FIG. 9*a;* and in curve *b* the response of the same microphone with no such damping element.

The acoustic transmission system of the invention comprises a damping element with a cavity formed behind the damping element. One useful embodiment of the inventive concept can be appreciated by reference to the sketch of FIG. 10. In FIG. 10, a receiver connects through a common or receiver duct R to a main duct M and also to auxiliary duct X. In the sketch of FIG. 10, the length of the auxiliary tubing is substantially equal in length to the length of the main tubing. The auxiliary tubing is blocked or plugged at the end remote from the receiver and fitted at the end closer to the receiver with a damping element D. A similar damping element D1 is placed in the tubing leading to the ear canal. The main duct M and auxiliary duct X provide alternative paths for the sound as it comes from the receiver. When the damping elements D and D1 are the characteristic impedance of the ducts, the acoustic impedance, when looking from the receiver toward the connection of the main and auxiliary tubes, is the characteristic impedance of the tubes except at very low frequencies. Thus, the impedance at this point is no longer substantially fluctuating, but is relatively constant; and, the transfer impedance from this junction to the ear canal is approximately equal to the characteristic impedance. The volume velocity (V) flowing into the ear canal chamber is approximately the sound pressure (P) at the junction divided by the characteristic impedance (Zo).

Figure 2:
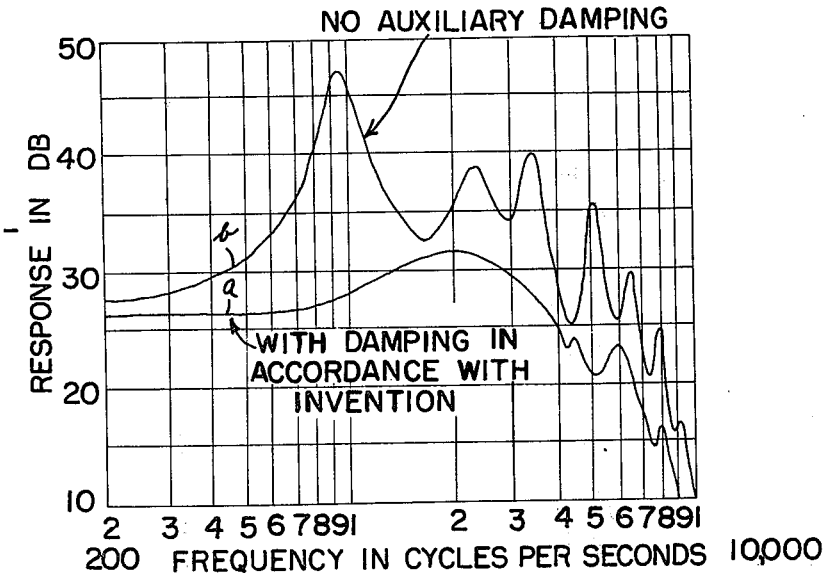
FIG. 2 is a graph of acoustical response versus frequency curves which are useful in explaining basic concepts of the present invention.

Another way of considering the foregoing is that the acoustical admittance of the main duct is complementary to the acoustical admittance of the auxiliary duct. As the frequency varies, the acoustical admittance of the main duct will change, and the acoustical admittance of the auxiliary duct will also change in an equal amount, but in an opposite or complementary manner. The result is that the combined admittance of the main and auxiliary ducts remain essentially constant and the output response is a relatively smooth curve as shown in FIG. 2.

Since the joining of the two tubes produces a combined impedance equal to the characteristic impedance of the tubes, it also forms a suitable termination for an additional length of the receiver duct R that connects the junction of the main and auxiliary tubes to the receiver. The impedance presented to the receiver is also the characteristic impedance of the tubes and the value of the transfer impedance remains equal to the characteristic impedance.

With this form of the inventive construction, the same transfer characteristic is provided utilizing substantial lengths of tubing, as is obtained by mounting the receiver at the ear canal with a damping element installed at the output of the receiver.

An important advantage of the invention is that the transfer characteristic remains substantially unaltered regardless of the length of the main acoustical transmission duct, so long as proper damping elements are used, and so long as an appropriate auxiliary duct is provided.

FIG. 4 illustrates a behind-the-ear hearing aid 11 embodying the principles of the present invention. The hearing aid 11 is illustrated as comprising a housing 13 which may be formed of a molded plastic. As is well known, the housing 13 includes a receiver 15, associated circuitry and power supply (not shown) for electronically processing the incident sound waves. Acoustic transmission channels couple the sound to a chamber formed adjacent the ear drum as will be explained.

In the construction shown in FIG. 4, the behind-the-ear hearing aid 11 includes a conventional hook portion 17 which is formed to go over the top of the ear and to be supported thereby. The end of the hook portion 17 couples through a suitable flexible tubing 19, which is inserted on the end of portion 17, to an ear mold 21 fitted in the ear of the user as is well known in the art.

As described hereinabove with respect to the sketch of FIG. 10, the inventive construction of FIG. 4 provides an improved acoustical coupling duct system 27 including a three outlet junction or connector 25 for coupling sound from the receiver 15 to the ear cavity. More specifically, a duct or tubing 23 couples sound from the receiver to the vertical arm of an inverted T-shaped junction 25 (see also FIG. 4*a*). In the drawing of FIG. 4*a*, acoustical damping elements 28 and 29 are positioned respectively in the horizontal arms 26 and 36. Horizontal arm 26 couples through a tubing or duct 24 positioned in hook portion 17 to the flexible tubing 19. The other arm 36 of the T-shaped junction 25 connects to an auxiliary acoustical assembly comprising a tubing 31 and a tubing extension 33 terminated by a plug 35 and mounted in folded-back relation with respect to tubing 31.

The operation of the structure of FIG. 4 is as described with respect to the sketch of FIG. 10. As explained above, the impedance of the main acoustical duct 27 when looking from the junction into the duct is that of an acoustical transmission line that is terminated by a very low impedance. The auxiliary duct 31 and the extension 33 measured from the T junction 25 to the remote end or plug 35 is substantially equal to the length of the main duct 27 measured from the T junction 25 through tubing 24 and 19 to the open end 30 of the tubing 19 which couples to the ear cavity. Damping elements 28 and 29 have the same characteristic impedance as the associated tubing.

As explained above, the acoustic impedance when looking at the joint pair is the characteristic impedance of the ducts; the impedance is relatively constant and the transfer impedance from the junction to the ear cavity is approximately equal to the characteristic impedance.

Since the joining of the two ducts 24 and 19, and of tubing 31 and extension 33 produces a combined impedance equal to the characteristic impedance of the ducts, this also forms a suitable termination for the additional length of the duct 23 connecting the junction to the receiver 15. The impedance presented to the receiver 15 is also the characteristic impedance of the ducts and the transfer impedance remains equal to the characteristic impedance.

Note that the cross sections of the ducts may have differing diameters. For example, the auxiliary duct 31 may be of a different diameter than the main duct 27 comprising tubing 19 and 24. The varying diameters of the various segments of the ducts and the length of the various segments may be emperically selected to provide a desired deviation from the transmission characteristics obtainable when the ducts are of the same diameters.

In FIG. 5, the present invention is utilized with a microphone in an eyeglass type of hearing aid 40. The temple 51 of the eyeglass is constructed by molding two mating halves 52 and 53 of the temple and then joining or glueing the two halves together to form the eyeglass temple 51. Sound channels or ducts 27A and 19A are formed as halves of cylinders in the two halves 52 and 53, and when the two halves are joined, a passageway is formed for sound.

The main sound duct 27A includes an opening 55 at the forward end of the temple 51 to admit sound and convey the sound through duct 27A, and a three-inlet junction or connector 23A to the microphone 4A.

In accordance with the invention, a damping element 28 is positioned adjacent the junction of duct 27A and Y-shaped connector 23A. One end of auxiliary duct 19A connects to the other inlet of the junction 23, and the remote end of duct 19A is sealed and auxiliary damping element 29 is positioned adjacent the junction of duct 19A and connector 23A. The operation of the structure of FIG. 5 is the same as that described above, and the response is as substantially shown in curve *a* of FIG. 3.

In the embodiment of FIG. 6, the invention is utilized with a receiver of an eyeglass type of hearing aid 41. In this embodiment, the main acoustical tubing or duct 27 couples through a suitable fitting 42 to the main duct 19; and, the auxiliary tubing 31 extends along the length of the eyeglass temple 43. In this construction, the connector 45 is also a three-outlet junction, in essentially a Y-shape, which couples the main duct 27 and the auxiliary duct 31 through the common duct 23 to the receiver 15.

The operation of the structure of FIG. 6 is as described above.

Another embodiment of the present invention is shown in FIG. 7 wherein a channel 47 is formed in a removable hook portion 17A of the hearing aid housing 13. The channel 47 is connected through a flexible tubing 23A to the receiver 15. The channel 47 includes a branch 49 formed near the end of the hook portion 17A which branch couples to an auxiliary tubing 32 terminated by a plug 35. A damping element 29 is placed in the branch 49 at a point near the junction of branch 49 and channel 47. A second and similar damping element 28 is placed in the channel 47. The end of hook portion 17A couples to flexible tubing 19, which in turn, is mounted in the ear mold 21.

Still another embodiment of the invention is shown in FIG. 8 wherein the main duct 27 and the auxiliary duct 31 are positioned to extend alongside one another within the housing 13 and hook portion 17B. The adaptation of this arrangement of parallel ducts to the microphone application as shown in FIG. 1 is straight forward.

Note also that this embodiment, as in the embodiment of FIG. 7, the hook portion 17B may be removable from the main housing 13. The main duct 27 and auxiliary duct 31 extend throughout the length of the hook portion 17B and throughout the length of the flexible tubing 19A. The length of the main duct 27, which has an open end, is the same as the length of the auxiliary duct 31 which is plugged by plug 35. Damping elements 28 and 29 are positioned respectively at the junction of main duct 27 and common duct 23, and auxiliary duct 31 and duct 23. The operation of the structure of FIG. 8 is similar to that described above for FIG. 4.

While the invention has been particularly shown and described with reference to preferred embodiments thereof, it will be understood by those skilled in the art that various changes in form and details may be made therein without departing from the spirit and scope of the invention.

What is claimed is:

1. An acoustic transmission system for acoustically coupling to an associated transducer and providing a relatively smooth output response therefrom, said system comprising in combination, first duct means having one end acoustically coupling to the transducer and its other end open, said first duct means effecting a first acoustical impedance, second duct means having one end acoustically connected to said first duct means, the other end of said second duct means which is remote from the first duct means being acoustically blocked, acoustic damping means in said second duct means, and said acoustic damping means having the characteristic impedance of said second duct means.

2. An acoustic transmission system as in claim 1 wherein the second duct means is of the same length as said first duct means and wherein an acoustically closed end terminates the remote end of said second duct means.

3. An acoustic transmission system as in claim 1 wherein said first duct and said second duct are of substantially the same length and cross section.

4. A system as in claim 1 further including a common duct means for acoustically coupling the transducer to said first and second duct means, the open end of said first duct means enabling the system to be acoustically coupled to an ear cavity and the blocked end of said second duct means providing a high impedance termination, and a second damping means having a similar impedance to said first damping means mounted in said first duct means, whereby the impedance presented by said system to sound from said transducer is relatively constant throughout the operating frequency range.

5. A system as in claim 4 wherein said common duct means couples at a junction with said first and second duct means, and wherein said first damping means is positioned in said second duct means adjacent the junction of said second duct means and said common duct means, and said second damping means is positioned in said first duct means adjacent the junction of said first duct means and said common duct means whereby a relatively smooth output response is obtained from said transmission system.

6. A system as in claim 1 wherein second acoustic damping means are positioned in said first duct means, said second damping means having a similar impedance as said acoustic damping means in said second duct means and having the characteristic impedance of said first duct means, and said first duct means and said second damping means providing an acoustical impedance which is complementary to the acoustical impedance of the second duct means and the acoustic damping means positioned therein whereby a relatively smooth output response is obtained from said transmission system.

* * * * *